US007904992B2

(12) United States Patent
Agster et al.

(10) Patent No.: US 7,904,992 B2
(45) Date of Patent: Mar. 15, 2011

(54) DOOR STOP

(75) Inventors: Brian P. Agster, Las Vegas, NV (US); William Hengler, Boulder City, NV (US)

(73) Assignee: Vegas Doorstop Industries Inc., Las Vegas, NV (US)

( * ) Notice: Subject to any disclaimer, the term of this patent is extended or adjusted under 35 U.S.C. 154(b) by 0 days.

(21) Appl. No.: 10/901,614

(22) Filed: Jul. 28, 2004

(65) Prior Publication Data

US 2006/0032017 A1 Feb. 16, 2006

(51) Int. Cl.
*E05F 5/02* (2006.01)

(52) U.S. Cl. ..... 16/82; 16/86 R; 16/374

(58) Field of Classification Search ..... 16/82, 86 R, 16/86 B, 374–376; D8/402; 280/47.19, 280/47.27; 292/288, 343, DIG. 15, 251.5
See application file for complete search history.

(56) References Cited

U.S. PATENT DOCUMENTS

| | | | | | |
|---|---|---|---|---|---|
| 83,967 | A | * | 11/1868 | Horrell | 292/288 |
| 314,105 | A | * | 3/1885 | Carnes | 16/223 |
| 485,613 | A | * | 11/1892 | Deane | 16/353 |
| 1,354,046 | A | * | 9/1920 | Lanning | 292/343 |
| 1,417,281 | A | * | 5/1922 | Robinson | 24/599.4 |
| 1,944,101 | A | * | 1/1934 | Meier | 16/86 A |
| 2,049,903 | A | * | 8/1936 | Flinn | 248/213.1 |
| 2,487,652 | A | * | 11/1949 | Heinrich | 211/119.004 |
| 2,509,502 | A | * | 5/1950 | Hunt | 248/290.1 |
| 2,883,226 | A | * | 4/1959 | Haynes | 49/417 |
| 2,896,791 | A | * | 7/1959 | Raber | 211/119.004 |
| 3,786,533 | A | * | 1/1974 | O'Donnell | 16/82 |
| 3,918,121 | A | * | 11/1975 | Williams | 16/319 |
| 4,114,234 | A | * | 9/1978 | Hogenson | 16/411 |
| 4,527,303 | A | | 7/1985 | Civitelli | |
| 4,630,854 | A | * | 12/1986 | Persson et al. | 292/343 |
| 4,831,688 | A | | 5/1989 | Deininger | |
| D309,708 | S | * | 8/1990 | Rosa et al. | D8/402 |
| 5,007,139 | A | * | 4/1991 | Ahern | 24/49.1 |
| 5,027,471 | A | | 7/1991 | Barnes | |
| 5,044,681 | A | | 9/1991 | Neighbors | |
| D323,976 | S | * | 2/1992 | Barnes | D8/402 |
| 5,369,840 | A | * | 12/1994 | Salvador et al. | 16/82 |
| 5,450,652 | A | | 9/1995 | Webb | |
| 5,511,837 | A | * | 4/1996 | Dempsey et al. | 292/288 |
| 5,560,080 | A | * | 10/1996 | Reed | 16/82 |
| 5,581,844 | A | | 12/1996 | Raheb et al. | |
| 5,586,793 | A | * | 12/1996 | Davenport | 292/67 |
| 5,711,557 | A | | 1/1998 | Nicolosi | |
| 5,727,289 | A | | 3/1998 | Reder | |
| 5,732,442 | A | * | 3/1998 | Haggard | 16/422 |
| 5,769,437 | A | * | 6/1998 | Gasperino | 280/47.27 |
| 5,881,431 | A | * | 3/1999 | Pieper et al. | 16/82 |
| 6,003,911 | A | * | 12/1999 | Sowash | 292/343 |
| 6,135,516 | A | * | 10/2000 | Gasperino | 292/343 |
| 6,149,212 | A | | 11/2000 | Kuntz et al. | |
| D455,644 | S | * | 4/2002 | Coffey | D8/402 |

FOREIGN PATENT DOCUMENTS

| | | | | |
|---|---|---|---|---|
| DE | 2834865 | A | * | 2/1980 |
| GB | 2382105 | A | * | 5/2003 |
| WO | WO 8200043 | A | * | 1/1982 |
| WO | WO 9523905 | A1 | * | 9/1995 |

* cited by examiner

*Primary Examiner* — Chuck Y. Mah
(74) *Attorney, Agent, or Firm* — Greenberg Traurig

(57) ABSTRACT

A door stop device comprising a block member, a receiving channel to facilitate placement of the device onto a door hinge, and an attaching means suitable for removably attaching the door stop device to an item of clothing worn by a user. The door prop device of the present invention is designed to be readily accessible and available for immediate use by those who primarily work in, or provide service to, the resort, hotel and motel industries.

12 Claims, 4 Drawing Sheets

DOOR STOP

FIELD OF THE INVENTION

The present invention relates generally to devices for propping-open doors and more particularly, to a device which is designed to be readily accessible to service personnel by attaching the door stop device to an item of clothing worn by a user of the device.

BACKGROUND OF THE INVENTION

Many modern hotels and motels in the resort industry are equipped with automatic closing doors. While these doors serve security and fire suppression functions when they are closed, there are many circumstances when it is beneficial to keep such doors open for brief periods of time. Hotel employees such as bellmen, room service, housekeeping, engineering, security and convention service personnel, all have occasions when regular passage through these doors is convenient. In those instances, it is beneficial to use a door prop device to keep the door open for the brief periods of time necessary. Bellmen, for example must enter rooms many times a day carrying bags for patrons. Their service is most conveniently performed when the door to the room being accessed can be held open by a door prop device. Conventional door prop devices however, are not designed to be easily and conveniently carried on the person of the service provider.

Conventional door stop devices are not suitable for the heavy fire-proof and security doors found in the modern luxury resort industry and most are not suitable for use where the exterior finish of the door must be protected from marks, scratches and dents.

Thus, there is a continuing need in the resort industry for a simple, economical and professional appearing door prop that can be easily carried on the person of service personnel in resorts of the highest quality and which is suitable for the needs of the modern hotel industry.

SUMMARY OF THE INVENTION

The door prop device of the present invention is designed to be readily accessible and available for immediate use by those who primarily work in, or provide services to, the resort hotel and motel industries. The door prop device is designed to always be readily accessible to the service personnel by attaching it to an item of clothing, preferably a sash or belt of the kind typically worn by personnel in these industries and yet still look professional. In order to adequately prop open the typically heavy, self closing doors of the resort industry, the device is constructed to slide over the top of a hinge pin and down alongside the hinge plates that attach the door to the door frame. Placement of the device on the center hinge of a door ensures that the door remains securely in the open position.

Also, the device is made of high quality durable rubber or plastic that will not mark even the most expensive finishes found in the high quality resort industry. The embodiments of the present invention are further directed to a method for improving access to a door chock device by resort industry personnel.

DETAILED DESCRIPTION

Figure 1:
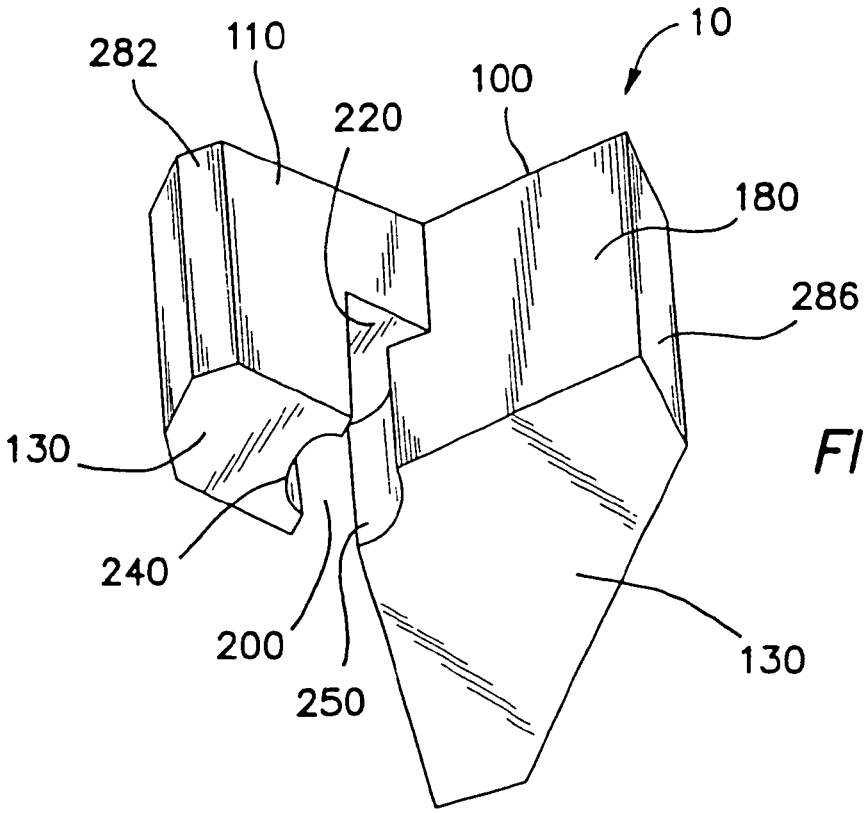
FIG. 1 is a perspective bottom view of a first embodiment of the present invention.

The device of the present invention is discussed herein with reference to an embodiment to be used in propping open a typical door equipped with an automatic closing device.

With reference to the drawings, a new and improved door prop device embodying the principles and concepts of the present invention and generally designated by the reference numeral 10 will be described. FIGS. 1 through 9, illustrate an improved door prop device 10, comprising a block member 100 and a securing member 110 contiguous with the block member 100. The block member 100 and the securing member 110 each have a top surface 120 and a bottom surface 130. These designations apply with the understanding that when the door prop device 10 is placed onto a vertically mounted hinge 140, having hinge pin 150 and hinge plates 160 & 170, best seen in FIG. 2. The bottom surface 130 of block member 100 is beneath the top surface 120 of the block member 100. The block member 100 contains at least two bumper walls 180 & 190.

A receiving channel 200 is formed intermediate the block member 100 and securing member 110. Receiving channel 200 is constructed of sufficient dimensions to fit over and otherwise engage hinge pin 150 and similar type pins.

Figure 2:
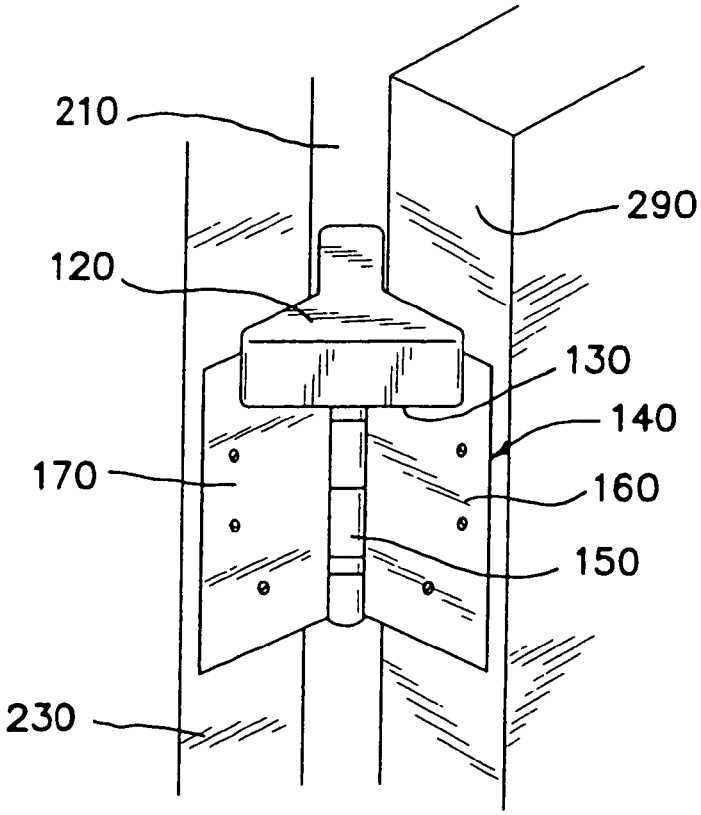
FIG. 2 is a perspective top view of the first embodiment of the present invention showing its placement into a position to obstruct a door from closing.

Turning now to FIG. 2, in practice, securing member 110 is placed into door space 210 by a user of the door prop device 10, such that the bottom surface 130 of block member 100 contacts the hinge pin 150. The user of door prop device 10 places downward pressure onto the top surface 120 of block member 100 and/or the top surface 120 of securing member 110 causing receiving channel 200 to engage a portion of hinge pin 150 and a portion of hinge plates 160 & 170. As the user continues downward pressure on top surface 120 of block member 110 the receiving channel 200 slideably engages the hinge pin 150 and hinge plates 160 & 170.

Figure 4:
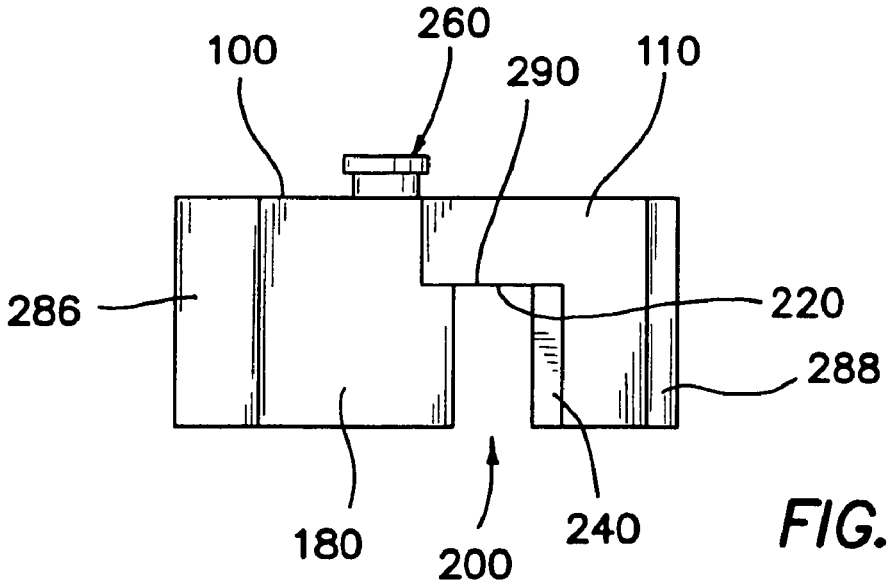
FIG. 4 is a side view of the first embodiment of the present invention showing the swivel collar attachment.

Referring now to FIGS. 1 & 4, receiving channel 200 has a depth, defined as the distance between the intersection of underside 220 of securing member 110 and the bottom surface 130 of bumper walls 180 & 190. The depth of the receiving channel 200 is sufficient to extend below a top portion of hinge pin 150 allowing bumper walls 180 & 190 to slide down alongside hinge plates 160 & 170, best seen in FIG. 2, until the underside 220 of receiving channel 200 abuts against a top portion of hinge pin 150.

At least two bumper walls 180 & 190 of block member 100 act as an abutment against hinge plates 160 & 170 of a door jam 230 thus preventing the automatic door 290 from closing against a door jam 230. In one embodiment, best seen in FIG. 6, concave surfaces 240 & 250 are formed along a portion of the depth of the receiving channel 200. This embodiment facilitates placement and engagement of the door prop device 10 over hinge pin 150.

Figure 3:
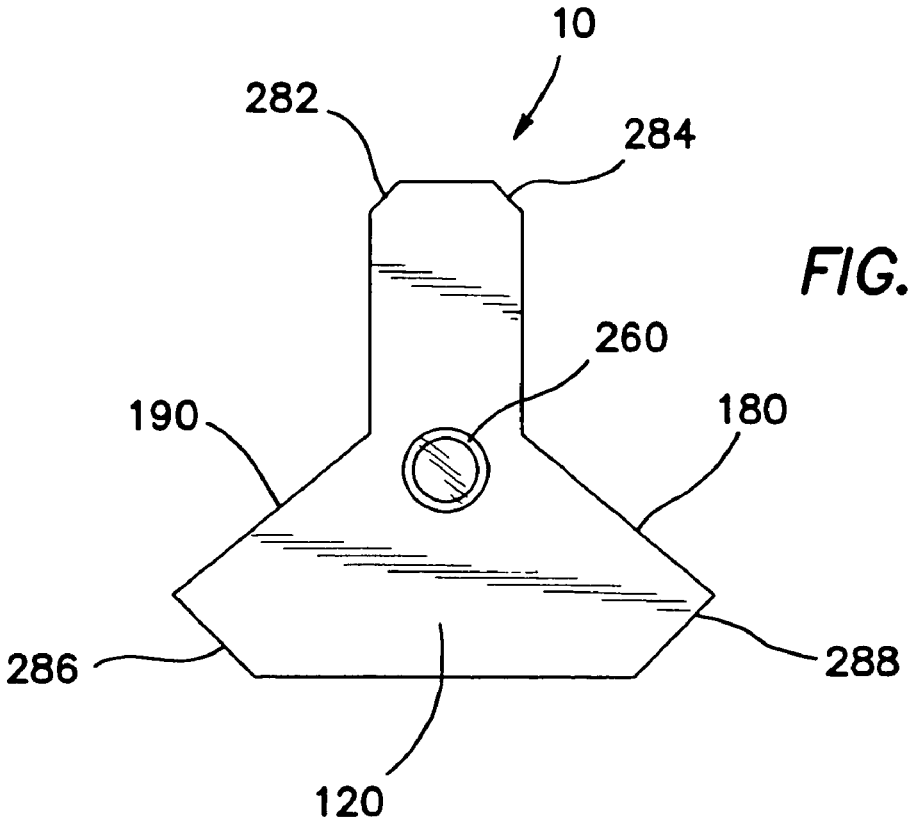
FIG. 3 is a top view of the first embodiment of the present invention showing a swivel collar attachment.
Figure 5A:
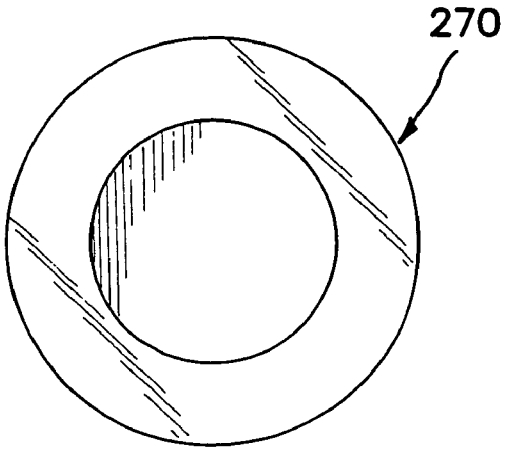
FIG. 5*a* is a plan view of the swivel collar.
Figure 5B:
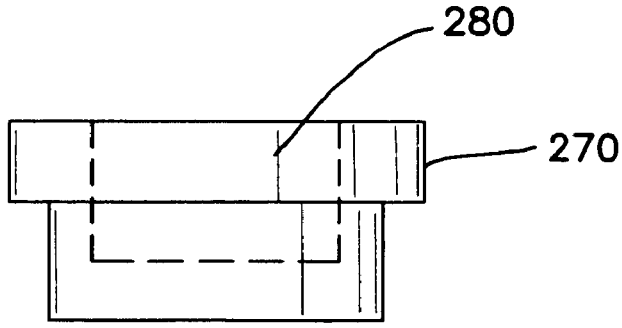
FIG. 5*b* is a cross-sectional view of the swivel collar.

One embodiment of the present invention includes an attaching element 260, best seen in FIGS. 3 & 4, integrated on the door stop device 10. The attaching element 260 facilitates removably attaching door prop device 10 to an item of clothing worn by a user of the door prop device 10. In one embodiment, attaching element 260 is disposed along a top surface 120 of block member 100 and/or securing member 110. In alternative embodiments however, attaching element 260 is disposed along a bottom surface 130 of door stop device 10. As shown in FIGS. 5*a* & 5*b*, attaching element 260 is a swivel collar 270 that is coupleable with a receptive device worn on the clothing or tool belt of a user. Swivel collar 270 couples with a corresponding U-shaped cavity 280 of the receptive device capable of being attached to a typical tool belt (not shown).

Figure 7:
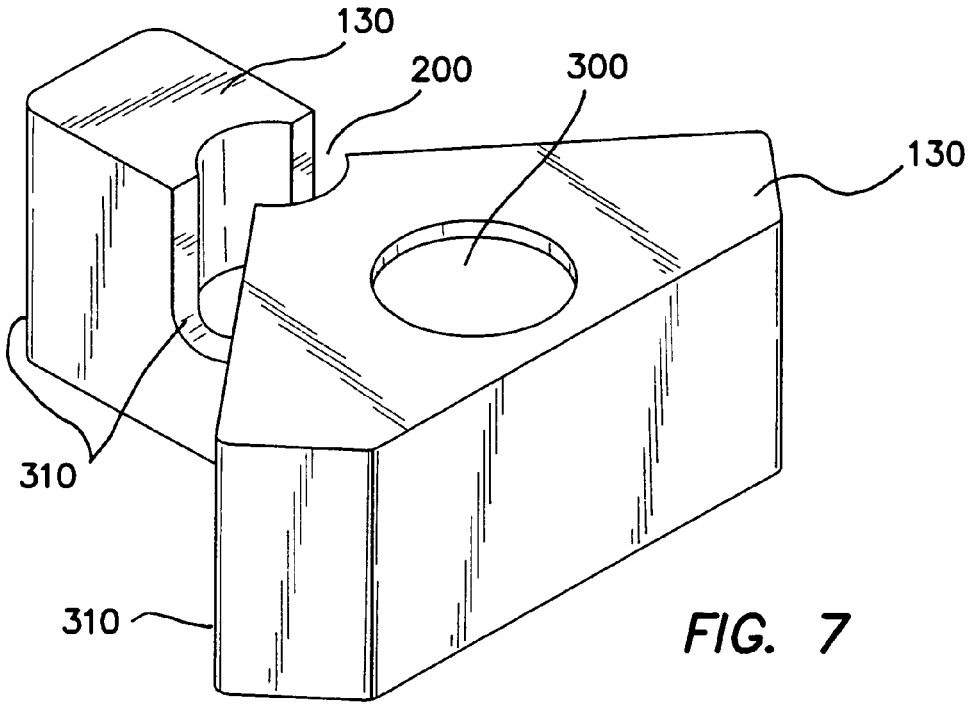
FIG. 7 is a perspective bottom view of a second embodiment of the present invention showing an attachment recess.
Figure 8:
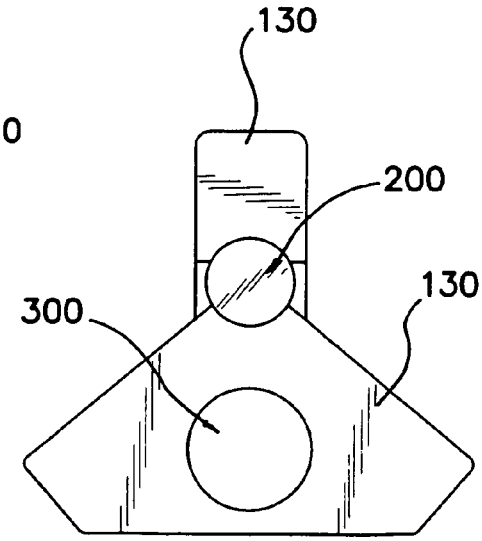
FIG. 8 is a bottom view of the second embodiment of the present invention.

In an alternative embodiment shown in FIGS. 7 & 8, a recess 300 integrated on bottom surface 130 accommodates an attaching element. Alternatively, the recess 300 may be integrated on the top surface 120. In this embodiment, the attaching element is an independent element that is affixed to the molded door stop device 10 rather than integrated therewith. The attaching element may be affixed using glue, epoxy, VELCRO® or any similar secure affixation means. The independent attaching element facilitates a simpler and more reliable door stop manufacturing process. That is, the molding process is more conducive to a compact unit not having extruding members such as the integrated attaching element 260.

In any embodiment, attaching element 260 or the independent attaching element can be any means for removably attaching the door stop device 10 to an item of clothing. Said means include a hook, a button, snap, strap, carabiner, hook and loop fasteners such as VELCRO®, or any other suitable means.

Figure 9:
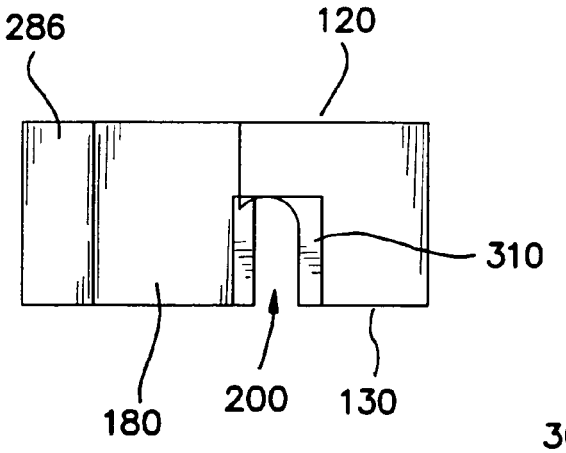
FIG. 9 is a side view of the second embodiment of the present invention.

In alternative embodiments as shown in FIGS. 7-9, block member 100 and securing member 110 vary in size and dimensions to accommodate different sizes and configurations of doors 290 and door jams 230. Also, as shown in FIGS. 7-9 certain edges 310 of the door stop 10 may be rounded. In one embodiment, block member 100 is fabricated of a solid slab of hard rubber or a synthetic polymer composition and it may be molded or constructed from any number of suitable materials. Such materials prevent the door stop device 10 from marking the exterior finish surface of the door 110 or the hinge plates 160 & 170 when the door 290 closes against bumper walls 180 & 190 of the door prop device 10.

Figure 6:
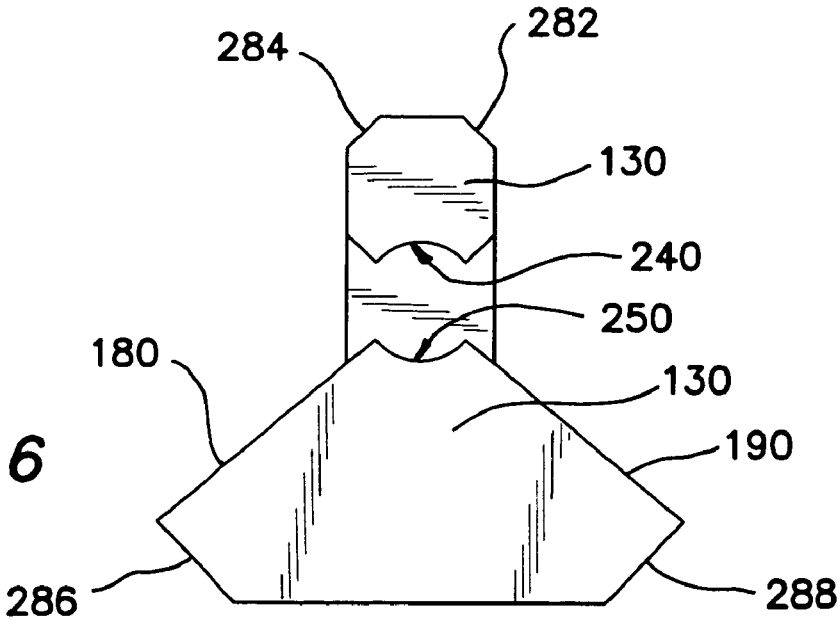
FIG. 6 is a bottom view of the first embodiment of the present invention showing a receiving channel.

In order to reduce the weight of the door prop device 10, tapered corners 282, 284, 286 & 288, best seen in FIGS. 1, 3 & 6, are formed in door prop device 10. Tapered corners 282, 284, 286 & 288 of securing member 110 facilitate placement of the door prop device 10 into open space 210 between the door 290 and the door jamb 230.

It should be understood that the particular embodiments described above are only illustrative of the principles of the present invention, and various modifications could be made by those skilled in the art without departing from the scope and spirit of the invention, thus, the scope of the present invention is limited only by the claims that follow.

We claim:

1. A door prop device comprising:

a triangularly-shaped block member connected to a securing member, said block-member and securing member sharing a single, substantially flat upper surface and separate, substantially flat lower surfaces in a same plane wherein said single, upper surface of said block member and securing member is substantially parallel to said separate, lower surfaces of said block member and securing member;

a receiving channel formed intermediate the block member and securing member, said receiving channel defined by a first concave surface on said block member and an oppositely facing separate, second concave surface on said securing member wherein the receiving channel is operable to engage, and substantially encase, a top portion of a hinge pin, said first and second concave surfaces divided by two oppositely positioned spaces; and wherein a first angled wall of said block member abuts a hinge plate on a door and a second angled wall of said block member abuts a hinge plate on a door jamb when said door prop device is positioned on a hinge pin.

2. The door prop device of claim 1, wherein an attachment means is integrated on the block member or securing member.

3. The door prop device of claim 2, wherein the attachment means is adapted to be removably attached to an item of clothing.

4. The door prop device of claim 2, wherein the attachment means is a swivel collar.

5. A door prop device comprising:

a triangularly-shaped block member;

a securing member connected to the block member, said block-member and securing member sharing a single, substantially flat upper surface and separate, substantially flat lower surfaces in a same plane wherein said single, upper surface of said block member and securing member is substantially parallel to said separate, lower surfaces of said block member and securing member;

an attaching element connected to the block member or securing member;

a receiving channel formed intermediate the block member and the securing member, said receiving channel defined by a first concave surface on said block member and an oppositely facing separate, second concave surface on said securing member wherein the receiving channel operable to engage, and substantially encase, a top portion of a hinge pin, said first and second concave surfaces divided by two oppositely positioned spaces; and wherein a first angled wall of said block member abuts a hinge plate on a door and a second angled wall of said block member abuts a hinge plate on a door jamb when said door prop device is positioned on a hinge pin.

6. The door prop device of claim 5 wherein the receiving channel is further operable to engage at least a portion of one hinge plate.

7. A door prop device comprising:

a triangularly-shaped block member;

a securing member connected to the block member, said block-member and securing member sharing a single, substantially flat upper surface and separate, substantially flat lower surfaces in a same plane wherein said single, upper surface of said block member and securing member is substantially parallel to said separate, lower surfaces of said block member and securing member;

an attaching element for removably attaching the door prop device to an item of clothing worn by a user, the attaching element disposed along a surface of the block member or securing member;

a receiving channel formed intermediate the block member and securing member, said receiving channel defined by a first concave surface on said block member and an oppositely facing separate, second concave surface on said securing member wherein the receiving channel operable to engage, and substantially encase, a top portion of a hinge pin and at least a portion of one hinge plate, said first and second concave surfaces divided by two oppositely positioned spaces; and wherein a first angled wall of said block member abuts a hinge plate on a door and a second angled wall of said block member abuts a hinge plate on a door jamb when said door prop device is positioned on a hinge pin.

8. The door prop device of claim 7 wherein the attaching member is adapted to be removably attached to an item of clothing.

9. The door prop device of claim 7 wherein the attaching element is a swivel collar.

10. A door prop device comprising:

a triangularly-shaped block member;

a securing member connected to the block member, said block-member and securing member sharing a single, substantially flat upper surface and separate, substantially flat lower surfaces in a same plane wherein said single, upper surface of said block member and securing member is substantially parallel to said separate, lower surfaces of said block member and securing member;

a means for removably attaching the door prop device to an item of clothing worn by a potential user, the means for removably attaching being disposed along a surface of the block member or securing member;

a receiving channel formed intermediate the block member and securing member, said receiving channel defined by a first concave surface on said block member and an oppositely facing separate, second concave surface on said securing member wherein the receiving channel operable to engage, and substantially encase, a top portion of a hinge pin and at least a portion of one hinge plate, said first and second concave surfaces divided by two oppositely positioned spaces; and wherein a first angled wall of said block member hinge plate on a door and a second angled wall of said block member hinge plate on a door jamb when said door prop device is positioned on a hinge pin.

11. A door prop device comprising:

a triangularly-shaped block member;

a securing member connected to the block member, said block-member and securing member sharing a single, substantially flat upper surface and separate, substantially flat lower surfaces in a same plane wherein said single, upper surface of said block member and securing member is substantially parallel to said separate, lower surfaces of said block member and securing member;

a recess on said securing member or block member, said recess for receiving an attaching element;

a receiving channel formed intermediate the block member and the securing member, said receiving channel defined by a first concave surface on said block member and an oppositely facing separate, second concave surface on said securing member wherein the receiving channel operable to engage, and substantially encase, a top portion of a hinge pin, said first and second concave surfaces divided by two oppositely positioned spaces;

wherein a first angled wall of said block member abuts a hinge plate on a door and a second angled wall of said block member abuts a hinge plate on a door jamb when said door prop device is positioned on a hinge pin.

12. The door prop device of claim 11 wherein the attaching element is secured within said recess.

* * * * *